United States Patent [19]

Cucchiara

[11] Patent Number: 4,949,957

[45] Date of Patent: Aug. 21, 1990

[54] ISOLATION LEVERAGE WEIGHT TRAINING CUFF

[76] Inventor: Alfred L. Cucchiara, P.O. Box 696, Los Alamos, N. Mex. 87544

[21] Appl. No.: 283,545

[22] Filed: Dec. 12, 1988

[51] Int. Cl.[5] ..... A63B 21/065

[52] U.S. Cl. ..... 272/119; 272/143; 128/77; 623/65

[58] Field of Search ..... 272/67, 68, 117, 118, 272/119, 122, 123, 143; 128/75, 77, 78, 80 R, 80 C; 623/65

[56] References Cited

U.S. PATENT DOCUMENTS

| | | | |
|---|---|---|---|
| 1,728,679 | 9/1929 | Hansard | 128/77 X |
| 2,287,821 | 6/1942 | O'Donovan | 128/77 |
| 3,180,641 | 4/1965 | Shane | 202/119 |
| 3,888,244 | 6/1975 | Lebold | 128/77 |
| 4,013,070 | 3/1977 | Harroff | 128/77 X |
| 4,484,740 | 11/1984 | Green | 272/119 |
| 4,544,155 | 10/1985 | Wallenbrock et al. | 272/143 X |
| 4,624,246 | 11/1986 | Ajemian | 128/78 X |
| 4,684,122 | 8/1987 | Desmond et al. | 272/143 X |
| 4,684,123 | 8/1987 | Fabry | 272/119 |
| 4,756,527 | 7/1988 | Ledbetter | 272/143 |

FOREIGN PATENT DOCUMENTS

| | | | |
|---|---|---|---|
| 217608 | 2/1909 | Fed. Rep. of Germany | 623/65 |

OTHER PUBLICATIONS

Advertisement for Conwat Lat Straps in "Ironman" Magazine, Aug. 1988, p. 98.

*Primary Examiner*—Robert W. Bahr

*Attorney, Agent, or Firm*—William A. Eklund

[57] ABSTRACT

An isolation leverage weight training cuff includes a tapered, flexible tube having multiple fasteners spaced longitudinally along its exterior surface. The cuff is worn on the forearm or the lower leg. The cuff is used to facilitate exercising of the large muscles groups of the upper arms or legs to exhaustion, without being limited by premature fatigue of the smaller muscles of the forearm or calf.

5 Claims, 6 Drawing Sheets

ISOLATION LEVERAGE WEIGHT TRAINING CUFF

BACKGROUND OF THE INVENTION

1. Field of the Invention:

The invention described and claimed herein is generally related to equipment and procedures used in weight training and body building. More particularly, the present invention is related to devices which are worn on the person for the purpose of enhancing the effectiveness of weight training exercises.

2. Description of Related Art:

It is well known among exercise physiologists and athletes that the development of maximum muscle size and maximum muscle strength is achieved when a muscle is periodically and regularly exercised to exhaustion. One problem with the application of this principle to the development of the large muscles of the upper arms is that, in order to exercise such muscles, the considerably smaller muscles of the forearm and hand must be used to grasp the weights or other training equipment. During the course of exercising the upper arms, the smaller muscles of the forearm and hands tend to fatigue sooner than the larger and stronger muscles of the upper arms. This fatigue of the smaller muscles frequently limits the ability to continue the exercise of the upper arm muscles, and commonly results in termination of the exercise session prior to attaining the desired level of fatigue in the upper arm muscles.

Additionally, the attainment of maximum muscle size, strength and definition in all of the major muscles of the upper arm and shoulder areas typically involves the performance of exercise routines which require grasping the weights in positions in which the wrist joint and the hands are inherently weak or in which they fatigue easily. That is, certain exercises require grasping the weights, or alternatively the handles of a weight training machine, in positions which quickly tire certain of the small muscles of the forearms and hands. For example, the common weight training exercise known as a reverse curl, in which a barbell is curled from a standing position with the palms of the hands facing downward, is useful for developing certain muscles of the upper arms. However, the usefulness of this exercise is substantially limited by the limited strengths of the wrists, and of the forearm extensor muscles which extend the wrists. As a result, with conventional weight training methods, the muscles of the upper arms that benefit from the reverse curl are rarely developed to their maximum potential. Likewise, some of the exercises commonly used to develop the deltoid muscles of the shoulders, for example the extended arm raises with dumbbells, are severely limited in their effectiveness as a direct consequence of the inherent weakness of the forearm and wrist extensor muscles.

In addition, the use of the hands and the wrist joint in these exercises inevitably allows movement of the hand during the exercise. This works contrary to the principle in weight training commonly known as isolation. In this regard, it is well known among athletes and exercise physiologists that maximum development of a muscle group occurs when the muscle group is exercised in isolation from other muscle groups, especially those which are functionally related to the muscle group being exercised and which therefore affect the performance of the exercised muscle group. Isolation of a muscle during an exercise allows the muscle to be exercised to fatigue without being limited or otherwise adversely affected by fatigue of other muscles. Thus, in any exercise involving the upper arm or torso muscle groups, it is desirable to isolate the muscles being exercised from the smaller muscles of the forearm, hands and wrist.

To some extent these same or related difficulties also exist with respect to the exercising of the muscles of the upper legs and lower torso. However these difficulties are even further exacerbated by the additional and inherent limitation which is imposed by the lack of grasping capability in the feet. This lack of grasping capability limits conventional weight training of the legs to conventional extension exercises, such as the standing leg squat for development of the quadriceps and gluteus maximus muscle groups, or the dead lift for the development of the hamstring and lower back muscle groups. These exercises do not of course require any grasping capability in the feet, and rely entirely on the ordinary function of the feet and legs to function primarily in extension only. To a modest extent this inherent limitation has been overcome by the development of weight training machines which allow the performance of a limited number of leg retraction exercises, using padded rollers and the like to apply resistance to the ankles and feet during such retraction exercises. However, commercially available weight training machines offer only a limited number of possibilities for retraction exercises, primarily leg curls, for example, and usually only in a limited number of fixed positions.

Accordingly, it is the object and purpose of the present invention to provide a device which facilitates weight training of the muscles of the upper arms and legs, as well the muscles of the upper and lower torso, by enabling such muscles to be exercised to exhaustion.

It is a more specific object of the present invention to provide a device which enables the muscles of the upper arms and legs and torso to be worked to exhaustion without fatiguing the smaller muscles of the forearms, lower legs, hands or feet.

It is another object of the present invention to provide a device which allows weight training to exhaustion of the muscles of the upper arms and legs, and which is not dependent on the performance of the relatively weak extensor muscles of the wrists and ankles.

It is another object of the present invention to provide a weight training device for effectively isolating the large muscles of the upper arms, legs and torso from the smaller muscles of the forearms, hands, and lower legs.

SUMMARY OF THE INVENTION

The present invention provides an isolation leverage weight training cuff which is primarily designed for exercising the large muscles of the upper arms and legs, in addition to the muscles of the upper and lower torso. The cuff comprises a tapered elongate flexible tube which is generally sized to fit snugly about the forearm, or about the calf area of the leg. The cuff includes attachment means for attaching the cuff to a weight training device. The attachment means are spaced apart along the length of the tube, such that a weight training device can be generally attached to the limb at any one of a number of positions along its length.

The invention is primarily intended for development of the major muscle groups of the upper arms and torso, although as will be appreciated the invention is equally applicable to the development of the major muscles of the upper legs and lower torso.

The invention is adapted for use with weight training machines having cables which are drawn under variable tensile loads, as well as with conventional free weights or other available weight training devices.

BRIEF DESCRIPTION OF THE DRAWINGS

The accompanying drawings, which are incorporated in and form a part of the specification, illustrate the preferred embodiment of the invention and, taken with the detailed description which follows, serve to explain the principles and operation of the invention.

In the Figures.

DETAILED DESCRIPTION OF THE PREFERRED EMBODIMENT

Figure 1:
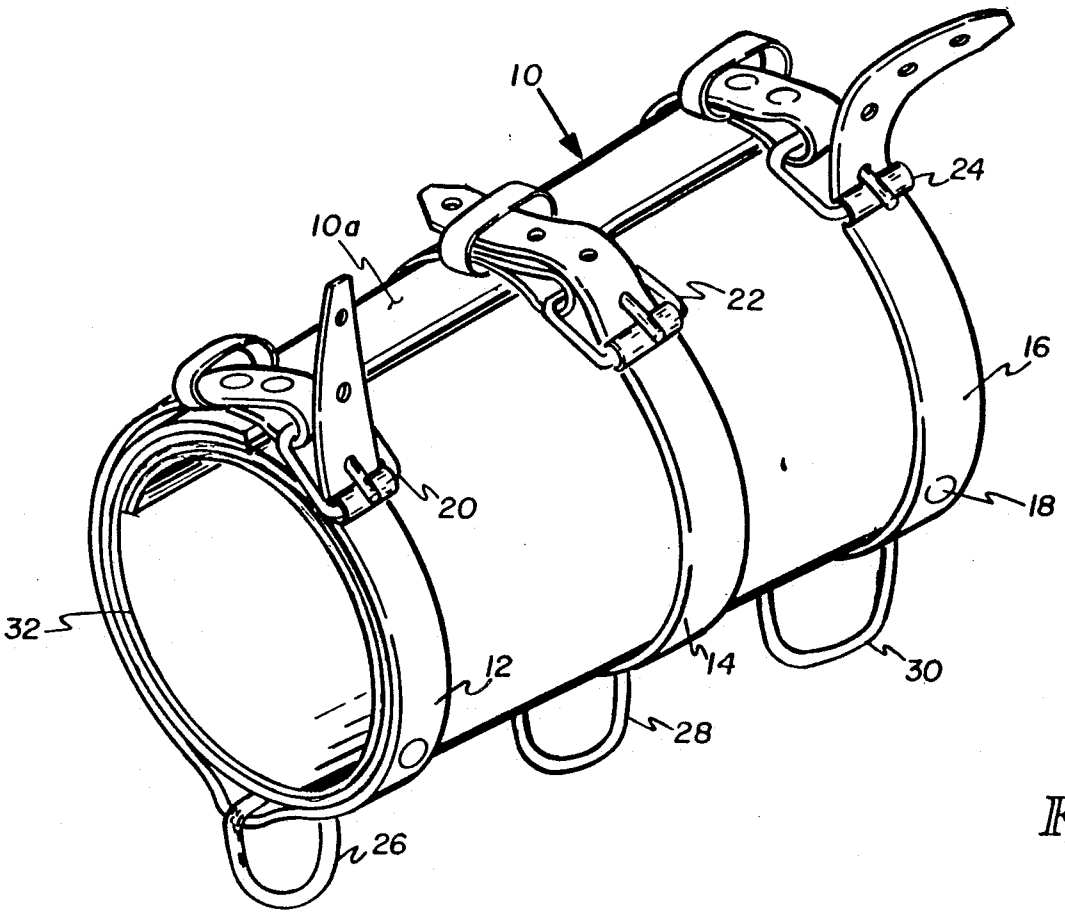
FIG. 1 is an isometric view of the isolation leverage weight training cuff of the present invention.
Figure 2:
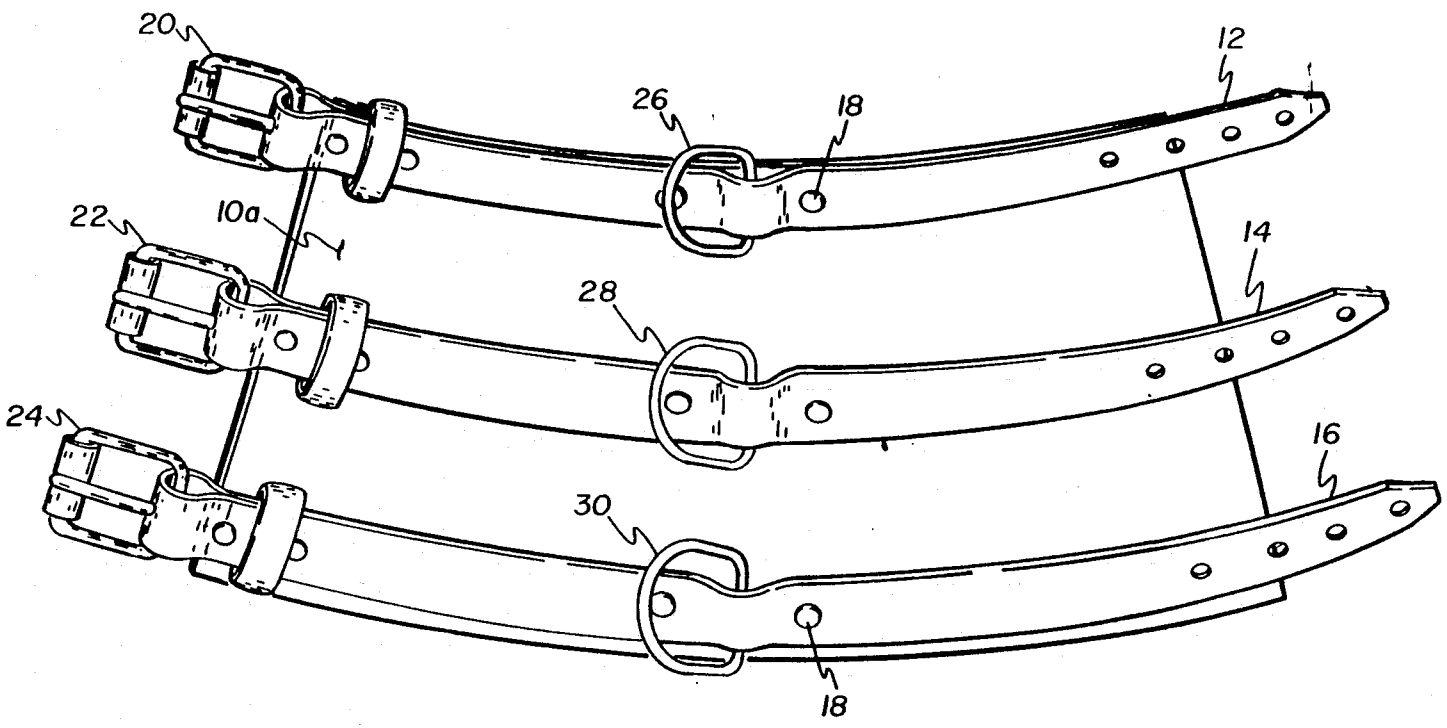
FIG. 2 is a plan view of the cuff of FIG. 1, unrolled and flattened for purposes of illustration.

Referring to the Figures, and particularly FIGS. 1 and 2, a preferred embodiment of the weight training cuff of the present invention is illustrated as including a tapered, flexible tube 10, which is generally sized and shaped to fit snugly over the forearm. Referring to FIG. 2, the tube 10 is formed of a single sheet **10*a* of a suitably strong, flexible material such as leather or nylon. As shown in FIG. 2, the sheet 10*a* is cut generally in the shape of a trapezoid having curved upper and lower edges, such that when it is rolled upon itself it forms a frustoconical tube that is generally sized and shaped to fit snugly over the forearm. Attached to the sheet 10*a* are three retaining straps 12, 14, and 16, which extend parallel to one another approximately across the full width of the flattened sheet. The retaining straps 12, 14 and 16 are affixed to the sheet 10*a* by means of rivets 18. The three straps 12, 14 and 16 are each provided at one end with buckles 20, 22 and 24**, respectively, and are provided with holes at the opposite ends.

At the centers of the straps, and also centered on the longitudinal center line of the sheet **10*a*, are D-rings 26, 28 and 30, respectively. The D-rings 26, 28 and 30 are sized to accommodate the various hooks commonly employed in weight training machines. The combination of the straps 12, 14 and 16 and the D-rings 26, 28, and 30** provides attachment means which are capable of supporting the substantial weights often employed by athletes in weight training.

The tube 10 is further provided with a liner 32 consisting of a layer of soft rubber, sheepskin, cotton or similar material, which is affixed to the inside surface of the sheet **10*a***.

Figure 3:
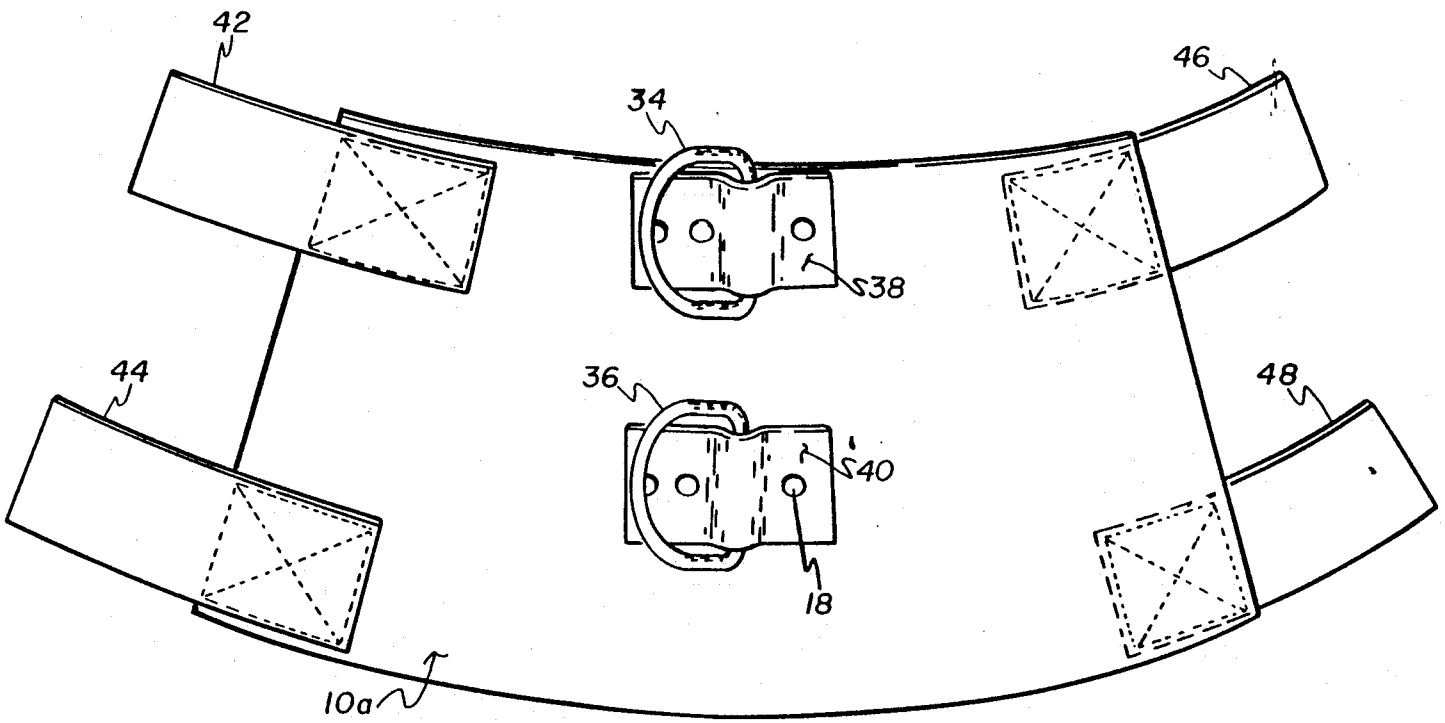
FIG. 3 is an alternative preferred embodiment of the isolation leverage weight training cuff.

An alternative embodiment is shown in FIG. 3. This embodiment includes a sheet **10*a*, with D-rings 34 and 36 fastened to the mid-section of the sheet 10*a* by means of leather strips 38 and 40, and rivets 18. The sheet 10*a* is fastened by means of hook and pile fasteners 42, 44, 46 and 48**. One advantage of this embodiment is that the hook and pile fasteners permit variable adjustment of the cuff to any desired fit.

Referring again primarily to FIGS. 1 and 2, the cuff is used by wrapping it around the forearm, or lower leg, and the straps 12, 14 and 16 are fastened to fit the sheet **10*a* snugly about the limb. One of the D-rings is then connected to the cable of a weight training machine and various weight training exercises are performed, using the weight machine in its ordinary manner except for the fact that the cable is connected to the cuff as opposed to being grasped with the hands by means of a handle or bar. It will be noted that the straps 12, 14 and 16 and their respective buckles effectively bear the full tensile load of the cable, with the sheet 10*a* serving to accurately and reproducibly position the straps. The sheet 10*a* also serves to spread the cable load over a larger surface area of the forearm than would be accomplished by the straps alone, and also cushions the load of the straps. It will also be noted that the sheet 10*a*** is sized to provide considerable overlap when wrapped about the forearm, with the overlapped portions immediately underlying the straps and their buckles. This further serves to disseminate the load and cushion the effect of the straps and buckles.

When used as an arm device, the cuff is ordinarily used in the common exercises used to develop the major muscles of the upper arm. These consist of the extension exercises, for example the various presses, which are used to develop the triceps series of muscles; and the retraction exercises, for example curls, used to develop the biceps muscles. However, it will be noted that the cuff is entirely rotatable about the forearm, so that the cuff may be additionally used in other exercises used to develop the deltoid muscle groups of the shoulders, the latissimus dorsii, and even the large muscle groups of the back. When so employed the cuff provides a flexibility of operation that is not available with the use of a weight training machine alone.

The use of the cuff for development of the upper leg and thigh muscles is similar. Most commonly the cuff may be used for retraction exercises to develop the hamstring set of muscles, which generally includes the gracilis, adductor magnus, semimembranosus, semitendinosus, biceps femoris, vastus lateralis, sartorius and quadratus femoris muscles. Alternatively the cuff may be used in extension exercises to develop the quadriceps sets of muscle groups. Additionally, the cuff may be used in a variety of other exercises to develop and or condition the other large muscles of the upper legs and thighs.

Figure 4:
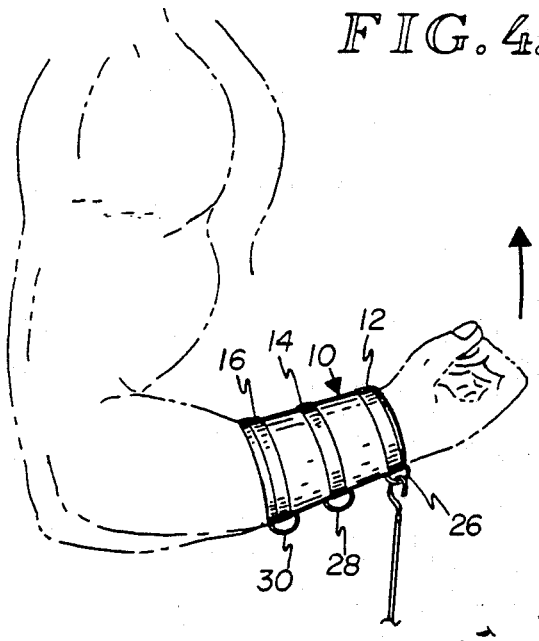
FIGS. 4 through 6 illustrate the progressive use of the embodiment of the invention shown in FIG. 1 in the performance of an arm curl exercise.
Figure 5:
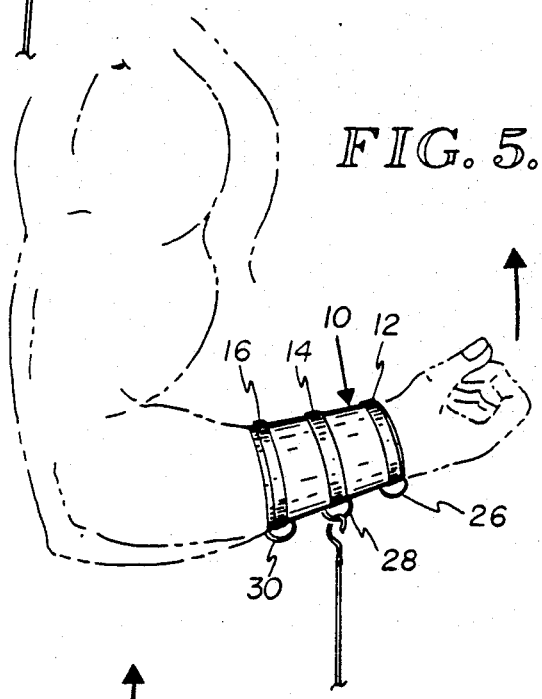
Figure 6:
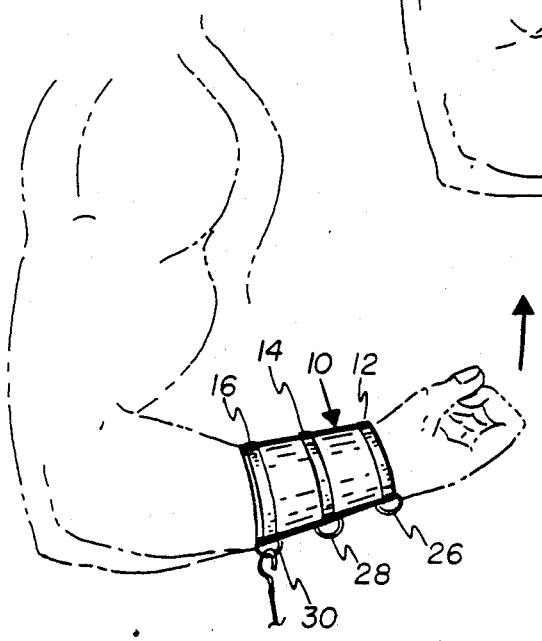

The cuff will ordinarily be used first by attaching the cable of a weight training machine to the distal D-ring 26, or the D-ring furthest from the fulcrum point defined by the elbow (or knee), as shown in FIG. 4. When the exercised muscle begins to fatigue, the cable is transferred to the intermediate D-ring 28, as shown in FIG. 5, and the same exercise is again performed to fatigue. Finally, the cable is connected to the proximal D-ring 30, as shown in FIG. 6, and the exercise finally performed to fatigue. As noted above, this procedure and the present invention allows the major muscles of the upper arm to be exercised to thorough fatigue without depending on or fatiguing the small forearm muscles that control the hands and fingers.

Figure 7:
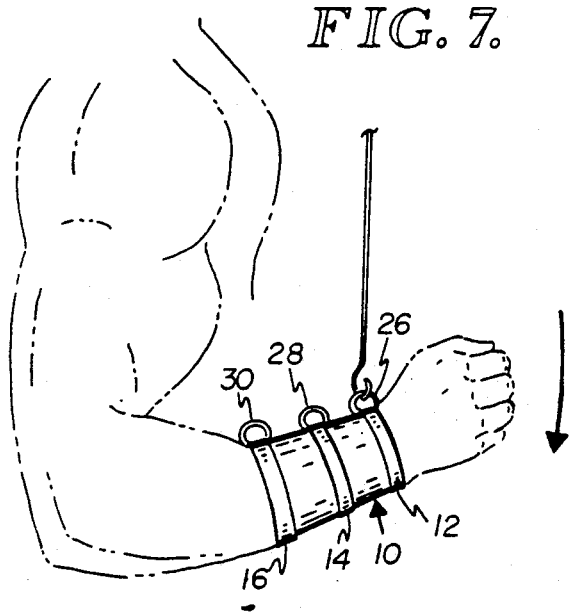
FIG. 7 illustrates the use of the embodiment shown in FIG. 1 in the performance of a triceps extension exercise.

FIG. 7 illustrates the use of the cuff for the purpose of a triceps exercise, in which the forearm is extended downwardly against the resistance of an upwardly extending cable. The advantage of using the cuff of the present invention in this exercise is that the hand and forearm can be held in their natural position, with the palm facing inwardly as shown, while the forearm is extended downward. In most exercises of this type, without the present invention, the palm must face downwardly because the hands must be used to grasp a horizontal bar attached to the cable. Thus the present invention allows this triceps exercise to be performed with the hands in a more natural position.

Figure 8:
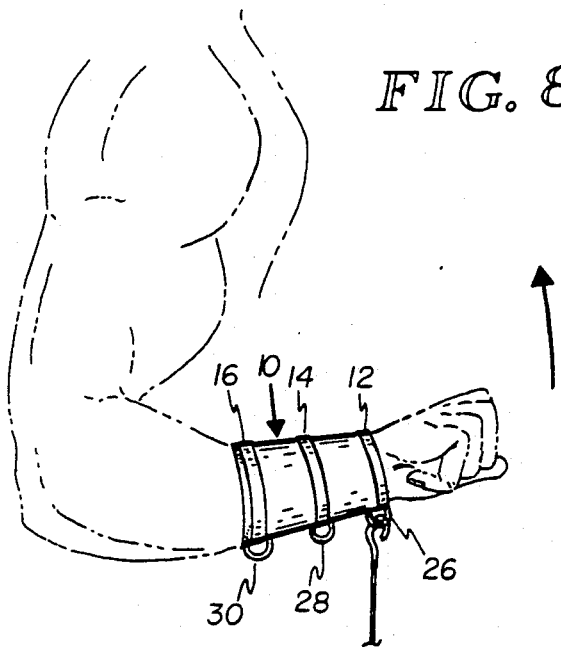
FIG. 8 illustrates the use of the embodiment shown in FIG. 7 in the performance of a reverse arm curl.

FIG. 8 illustrates the use of the cuff in the performance of a reverse curl exercise. In this exercise the palms face downward and the forearm is raised against the resistance of the downwardly extending cable. As discussed above, this exercise is ordinarily quite limited by the inherent weakness of the wrist and hand. However, with the present invention this exercise can be performed without depending on the strength of the wrist extensor muscles, and thus can be performed to the maximum benefit of the muscles of the upper arm and forearm.

Figure 9:
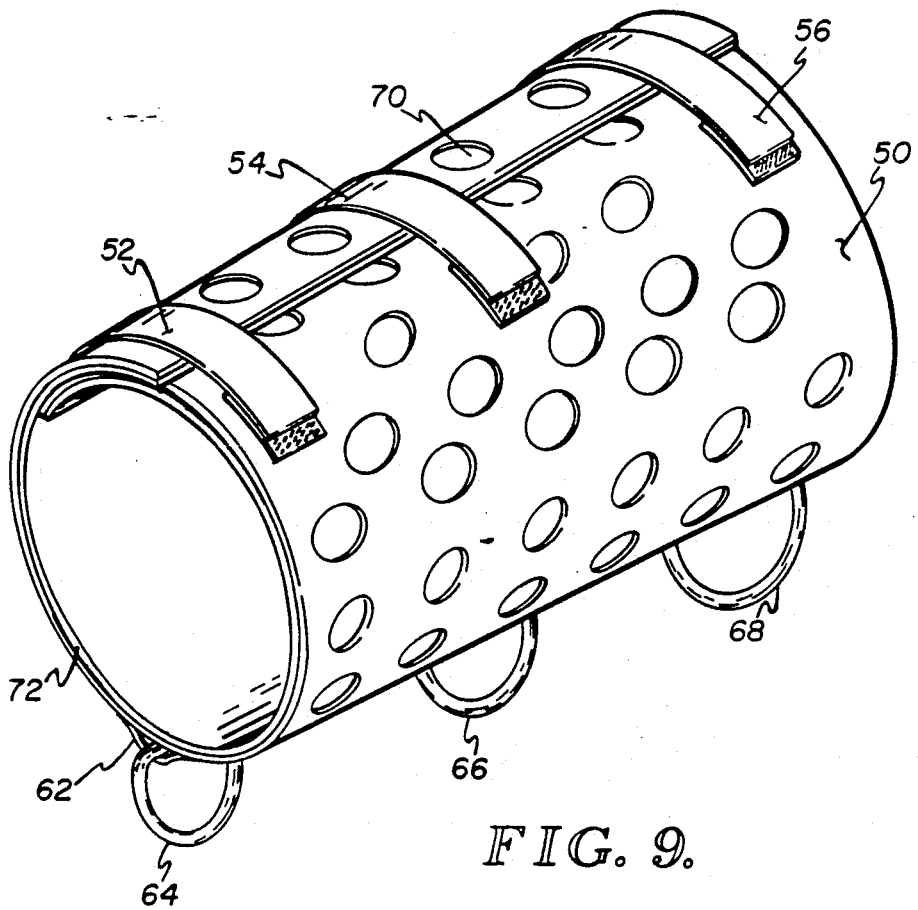
FIG. 9 illustrates a second alternative embodiment of the invention.
Figure 10:
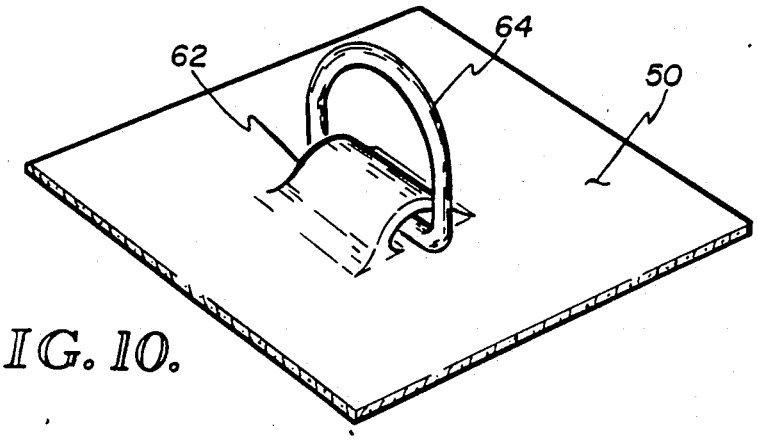
FIG. 10 illustrates a detail of construction of the embodiment shown in FIG. 9.

FIGS. 9 and 10 illustrate a second alternative embodiment of the present invention, including a polymeric cuff 50 having hook and pile fasteners 52, 54 and 56. D-rings 64, 66 and 68 are attached to the cuff 50 on the opposite side of the fasteners 52, 54 and 56 by means of integral bosses 62 (shown in FIG. 10) formed in the cuff 50. The cuff 50 further includes ventilation perforations 70 and a liner 72.

It will be noted that the use of the cuff as described above results in increasing leverage being applied to the weight training device. For example, in the simple standing curl exercise, the resistance provided by the weight training machine or free weight is moved progressively from the wrist area toward the elbow area as the biceps muscle fatigues over a series of exercise sets, without changing the amount of the resistance. This is to be contrasted with the conventional weight training using the same biceps curl exercise, in which the resistance is lowered by progressively decreasing the weight resistance being lifted. The use of the cuff offers the advantage of being able to change the leverage effect of the elbow without changing the weight resistance, in addition to changing the weight resistance if desired.

Additionally, the cuff of the present invention serves to isolate the muscles being worked. By eliminating the need for use of the forearm or lower leg muscles during exercise of the upper arm or leg muscles, the latter muscles are effectively isolated and can be exercised to fatigue in strict isolation. As is well known among exercise physiologists and athletes, the isolation of the muscle groups worked during weight training exercises is desirable, as it enables rotation over a period of days of the exercise of different muscle groups independently of one another.

Another advantage of the cuff of the present invention is that the large muscles of the upper arms or legs can be worked at angles and positions which are often not practical with conventional weight training methods. For example, the triceps group of muscles of the upper arm are commonly exercised using a vertical cable pull-down machine. This is normally performed with a horizontal bar or a an inverted V-shaped bar attached to the cable, with the bar being grasped with the hands and pushed down while in a standing position. This exercise is not performed however with the hands in the most natural position for this exercise, namely with the palms of the hands facing inwardly toward one another. To do so would require a vertical bar extending parallel to the vertical cable, but the hands are not sufficiently strong to grasp a vertical bar for the period of this exercise. The cuff of the present invention overcomes this problem, however. The cuff can be rotated into any position about the forearm, thus allowing a full set of this triceps exercise to be performed with the palms of the hands facing one another.

It is further believed that the cuff reduces the occurrence of tendonitis and tenosynovitis, conditions which occasionally develop as a consequence of weight training, and also facilitates continued training by individuals already afflicted with these conditions. Additionally, the cuff enables development of the upper arms and torso in individuals having physical impairments in the hands or wrists.

It will be understood that any reference to the use of the present invention in connection with the development of the arm or upper body muscles is by way of illustration only, and that the invention is equally useful for use in connection with the development of the upper leg, thigh, back and abdomen muscles.

The present invention is described herein by reference to the preferred embodiments described above and illustrated in the Figures. However, it will be understood that various modifications, variations and alterations may be obvious to those of ordinary skill in the art. Accordingly, the scope of the invention is defined only by the following claims.

The embodiments of the invention in which protection is claimed are:

1. An isolation leverage weight training cuff comprising a tapered flexible tube adapted to fit snugly about a limb, said tapered flexible tube being split longitudinally, said tapered flexible tube having on the exterior surface thereof a plurality of first fastening means for fastening said cuff to a weight training device, said plurality of first fastening means being spaced apart and secured longitudinally along said tube, said plurality of first fastening means being sized to receive a releasable attachment of a weight training device and being sufficiently secured to said tube for bearing the load of the weight training device, whereby a weight training device can be selectively attached to said cuff at a plurality of positions along said cuff which correspond to different positions along said limb, and said tapered tube further including a plurality of second fastening means for fastening said tube about a limb, said second fastening means being adjustable in position so as to accommodate limbs of various sizes and shapes.

2. The isolation leverage weight training cuff defined in claim 1 wherein said first fastening means comprises a plurality of D-rings affixed to said tapered flexible tube, said D-rings being affixed to said cuff in a manner so as to support the substantial weight commonly used in weight training.

3. An isolation leverage weight training cuff comprising a flexible, tapered tube appropriately sized and shaped to fit snugly about the forearm, said flexible, tapered tube being split longitudinally, said tube including a plurality of attachment means on the exterior surface thereof for attaching a weight training device at variable positions along the length of said tube, said plurality of attachment means being spaced apart and secured longitudinally along said tube, said plurality of attachment means being sized to receive a releasable attachment of a weight training device and being sufficiently secured to said tube for bearing the load of the weight training device, whereby the muscles of the upper arm and torso can be exercised to exhaustion using varying leverage points without reliance upon the muscles of the forearm, and said tapered tube further including a plurality of fastening means for fastening said tube about a limb, said fastening means being adjustable in position so as to accommodate limbs of various sizes and shapes.

4. The isolation leverage weight training cuff defined in claim 3 wherein said tube is formed of a flexible polymeric material, said attachment means includes a plurality of D-rings, and wherein said tube includes integral bosses to which said D-rings are affixed.

5. The isolation leverage weight training cuff defined in claim 4 wherein said tube includes multiple ventilation perforations.

* * * * *